United States Patent [19]

Tsunekawa

[11] Patent Number: 4,947,199

[45] Date of Patent: Aug. 7, 1990

[54] PHOTOGRAPHIC PROCESSING UNIT

[75] Inventor: Yoshitoshi Tsunekawa, Tokyo, Japan

[73] Assignee: Kotobuki Sangyo Co., Ltd., Tokyo, Japan

[21] Appl. No.: 377,034

[22] Filed: Jul. 10, 1989

[30] Foreign Application Priority Data

Jul. 12, 1988 [JP] Japan ..... 63-173191

[51] Int. Cl.[5] ..... G03D 3/06; G03D 3/08

[52] U.S. Cl. ..... 354/322; 354/324

[58] Field of Search ..... 354/317, 319, 320, 321, 354/322, 324

[56] References Cited

U.S. PATENT DOCUMENTS 3,774,521 11/1973 Beck ..... 354/317

4,577,949 3/1986 Geyken et al. ..... 354/324

FOREIGN PATENT DOCUMENTS 1164396 10/1958 France ..... 354/324

1411343 10/1975 United Kingdom ..... 354/317

*Primary Examiner*—A. A. Mathews

*Attorney, Agent, or Firm*—Sughrue, Mion, Zinn, Macpeak & Seas

[57] ABSTRACT

A photographic processing apparatus for processing film includes processing units, such as developing, fixing and rinsing units, each of which is constructed to cause the film to be conveyed in a straight horizontal path between conveyance rollers, none of which are immersed in processing liquid. Each processing unit includes at least one processing chamber defining member extending longitudinally across the path of said film and carrying processing liquid in a chamber defined therein. The chamber is open to the moving film via an inlet slot and an exit slot. Pairs of conveyance rollers are positioned just upstream and just downstream of said inlet and outlet slots, respectively. Liquid conveyance means pumps a processing liquid through said chamber and picks up the processing liquid exiting the chamber via the slots and being squeezed off the film by the rollers.

9 Claims, 5 Drawing Sheets

PHOTOGRAPHIC PROCESSING UNIT

BACKGROUND OF THE INVENTION

The present invention relates to a photographic processing unit for photographic photosensitive material, such as an exposed photographic film and exposed photographic printing paper, and particularly relates to a photographic processing unit suitable for a compact automatic photographic processing apparatus.

In professional and amateur photographic processing places, hospitals, clinics and so forth, an exposed black and white photographic photosensitive material, such as a black and white photographic film, black and white photographic printing paper and an X-ray film, is conventionally developed in a constant-temperature vessel by an operating person in a darkroom while the developed image on the material is inspected by his naked eyes. For such manual development, the operator must control the period of time of the development based on his hunch and also must control the temperature of the developing and the fixing solutions for the material based on his hunch, while looking at a thermometer. For that reason, he cannot always carry out the development operation under optimal conditions, and an unskilled person cannot properly perform the development operation. This is a problem. Additionally, the darkroom occupies a considerably large amount of space. This is another problem. Since it is dark in the darkroom, it is not easy to perform the development operation. This is yet another problem. If a dentist enters into the darkroom to develop every single exposed dental X-ray film, the efficiency of his work is greatly deteriorated. This is a big problem.

In order to solve the above problems, a roller-type automatic developing apparatus, as shown in FIG. 6, for performing development in a darkroom was proposed and has been put into practical use. The developing tank 2 of the apparatus 1 is divided into at least four sections, including a developing chamber 3, a fixing chamber 4, a rinsing chamber 5 and a drying chamber 6. Since a developing solution 8, a fixing solution 9 and rinsing water 10 are simply contained in the developing chamber 3, the fixing chamber 4 and the rinsing chamber 5, respectively, an exposed photographic film 11 needs to be moved carefully in a zigzag vertical path, as shown in FIG. 6, so as to be dipped in the processing liquids in the respective chambers, as the film is conveyed. For that reason, some film conveyance rollers 12 are within the developing and the fixing solutions 8 and 9, thereby likely causing the rollers to become contaminated or damaged. This is a problem. Since as many as forty-eight film conveyance rollers 12 are provided to convey the film 11, the length of the apparatus 1 is so large that it cannot be made compact. This is another problem. Since the film conveyance rollers 12 are moved down by a prescribed distance so as to be dipped in the developing and the fixing solutions 8 and 9 and the rinsing water 10, the line of the rollers meanders up and down so that the film 11 being conveyed by the rollers is moved in zigzag fashion. For that reason, the film 11 repeatedly undergoes bending, and is therefore likely to be damaged. This is yet another problem. Since the film conveyance rollers 12 are likely to become contaminated, they will not rotate smoothly, and the development of the film 11 is likely to be nonuniform. This is yet another problem.

Photographic processing apparatus each for processing a photographic photosensitive material while moving it in a horizontal direction is disclosed in German Patent No. 1,293,586 and U.S. Pat. No. 4,577,949. Each such apparatus includes upper and lower processing liquid chambers divided from each other so that a processing chamber is defined between the processing liquid chambers. Conveyance rollers are provided at the front and rear of the processing liquid chambers. The photosensitive material is conveyed in the horizontal direction through the processing chamber as the material is moved between the conveyance rollers. At that time, a processing liquid is supplied from the upper and the lower processing liquid chambers to the processing chamber to process the material. However, the constitution of the processing liquid chambers is complicated. This is a problem. In particular, the constitution of the processing liquid chambers of the apparatus disclosed in the United States Patent is very complicated because of the presence of a comb-like member provided in a liquid passage in the processing chamber in order to improve the uniformity of the processing liquid therein. Also, the conveyance rollers are present in the processing liquid or retain the liquid, so that the rollers are contaminated, causing them to rotate erratically and result in nonuniform development of the material. This is another problem.

SUMMARY OF THE INVENTION

The present invention was made in order to solve the above-mentioned problems of the conventional arts.

Accordingly, it is an object of the present invention to provide a photographic processing unit of very simple constitution for processing photographic photosensitive material, in which conveyance rollers for the material are not dipped in a processing liquid and are therefore hardly contaminated with the liquid.

It is another object of the present invention to provide a photographic processing unit suitable for a compact automatic photographic processing apparatus in which a photographic photosensitive material is processed while being moved in a horizontal direction.

It is yet another object of the present invention to provide a photographic processing unit suitable for a compact automatic photographic processing apparatus which can be used in a light room.

It is yet another object of the present invention to provide a photographic processing unit suitable for an automatic photographic processing apparatus which is used in a light room so that a photosensitive material of relatively small size, such as exposed dental X-ray film, is processed in a very short time.

In each of the photographic processing units, a photographic photosensitive material exposed to imaging light is processed while being moved in a horizontal direction. Each of the units is characterized in that the unit includes two pairs of conveyance rollers, and a processing chamber definition member; the rollers extend in parallel with each other and are disposed at a prescribed distance from each other in the horizontal direction so as to convey the material horizontally; the member is disposed between the pairs of conveyance rollers and extends in parallel with the rollers perpendicularly across the direction, over the total width of the material; a processing chamber is defined in the member; the member has inlet and outlet slots along the horizontal direction so that the material is moved into the member through the inlet slot and moved out of the member through the outlet slot; a processing liquid feed port for feeding a processing liquid into the processing chamber is provided in the member at the butt thereof; and the member is closed at the tip thereof.

Each of the photographic processing units is used to process photographic photosensitive material, such as color film, black and white film, X-ray film, color printing paper and black and white printing paper, which has been exposed to imaging light. The processing steps include development, bleaching, fixation, rinsing, drying or the like. The specific processing depends on the type of photosensitive material being processed. Each photographic processing unit is suitable for a compact automatic photographic processing apparatus in which development, fixation, rinsing, drying and the like are compactly performed. Each unit is particularly suitable for a compact automatic processing apparatus by which a dental X-ray film is processed in a dental clinic or the like.

DETAILED DESCRIPTION OF A PREFERRED EMBODIMENT

An embodiment of the present invention is hereafter described with reference to the drawings attached hereto.

Figure 1:
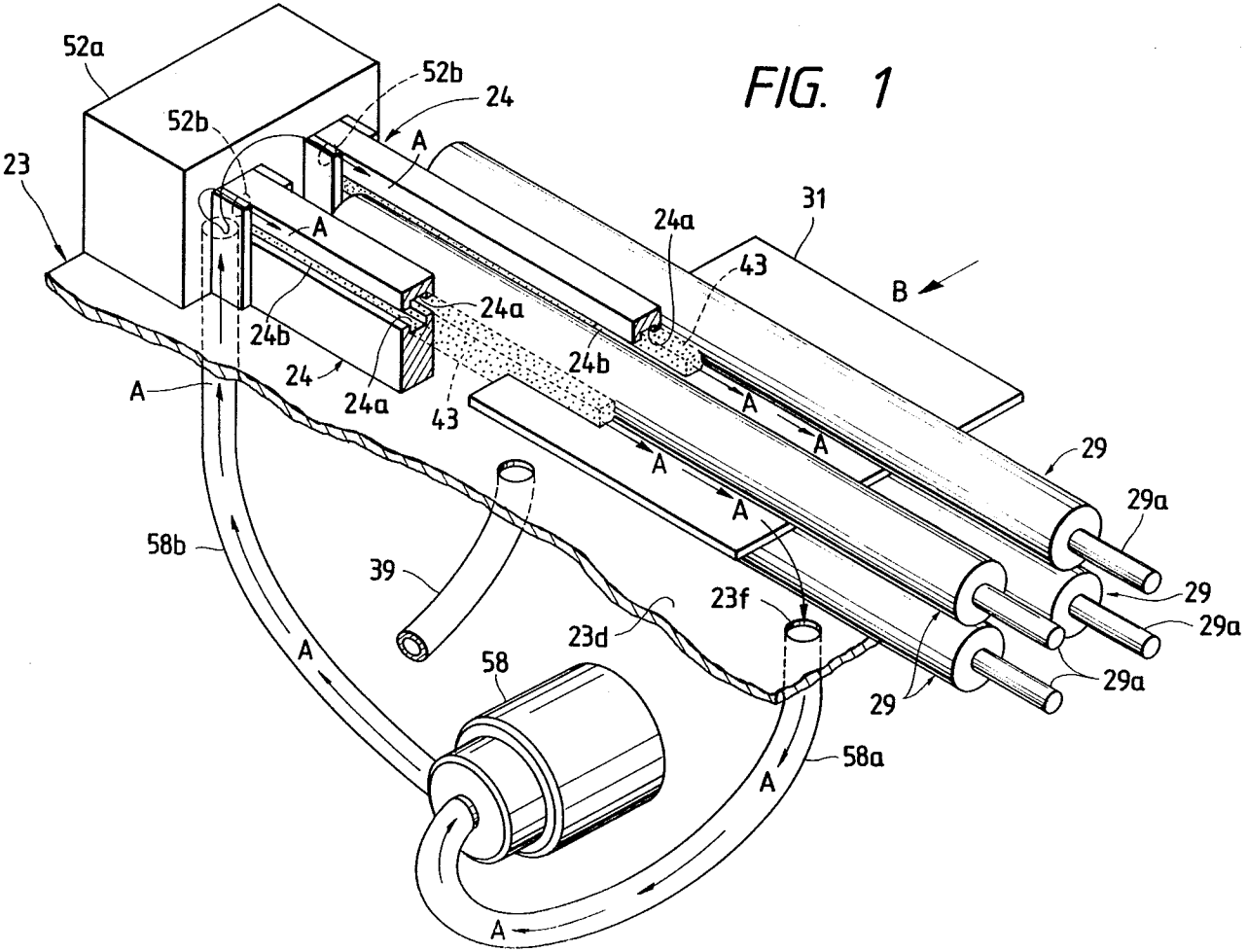
FIG. 1 is a perspective view of a photographic processing unit according to a preferred embodiment of the present invention.

FIG. 1 is a perspective view of a photographic processing unit used in an automatic developing apparatus for developing a dental film in a room which need not be darkened. Another kind of black and white film, color film, printing paper or the like may be also developed by the apparatus. The photographic processing unit includes a pair of developing chamber definition members 24 extending from a developing solution stand 52*a* perpendicularly across the direction B of the movement of the dental film 31, over the total width thereof. One of the members 24 extends between two pairs of film conveyance rollers 29 extending in parallel with each other perpendicularly to the direction B of the movement of the film 31 and having a prescribed clearance between the rollers, and is located at a prescribed distance from the rollers. The other member 24 is located in front of the upstream pair of film conveyance rollers 29 with regard to the direction B of the movement of the film 31, and extends between the upstream pair of rollers and another pair of film conveyance rollers not shown in the drawing. Although it is preferable that the two developing chamber definition members 24 are provided to increase the speed of development of the film 31, the present invention is not confined thereto but may be otherwise embodied so that only one developing chamber definition member is provided. Each of the members 24 has an upper groove 24*a* and a lower groove 24*a*, together constituting a developing chamber in the member, and has an inlet slot 24*b* and an outlet slot 24*b* in the front and rear portions of the member so that the film 31 enters into the member through the inlet slot and goes out of the member at the outlet slot. The members 24 are secured at the butts thereof to the developing solution stand 52*a* and closed at the tips—not shown in the drawing—of the members.

The developing solution stand 52*a* is provided with developing solution feed ports 52*b* at the butts of the developing chamber definition members 24 so that a developing solution 43 sent from a pump 58 to the stand through a feed pipe 58*b* is fed, under pressure, to the developing chambers in the members 24 through the feed ports in directions A perpendicular to that of the movement of the film 31, to develop the film in the developing chambers. It has been confirmed that the developing solution 43 very smoothly flows through the developing chambers, nearly without leaking out of the slots 24*b* of the members 24 at the intermediate portions of the chambers, at the beginning of the feed of the solution to the chambers. When the developing solution 43 has reached the tips of the members 24 and fills the developing chambers, the solution begins to flow out of the slots 24*b* of the members. At that time, the solution 43 develops the film 31 being conveyed by the conveyance rollers 29 and passing through the slots 24*b* and the developing chambers. The developing solution 43 which flows out of the slots 24*b* is accumulated in the developing tank 23 at the bottom thereof and sent again to the developing solution stand 52*a* by the pump 58 through the drain hole 23*f* of the bottom of the tank, a recovery pipe 58*a* and a feed pipe 58*b*. An appropriate gap is set between each developing chamber definition member 24 and each conveyance roller 29 so that the developing solution 43 flowing out of the slots 24*b* is prevented from coming into contact with the roller.

Although the bottoms of the developing chamber definition members 24 are secured to the bottom plate of the developing tank 23, the present invention is not confined thereto but may be otherwise embodied so that the members are supported at both the ends thereof and the bottoms of the members are out of contact with the bottom plate of the tank.

Figure 2:
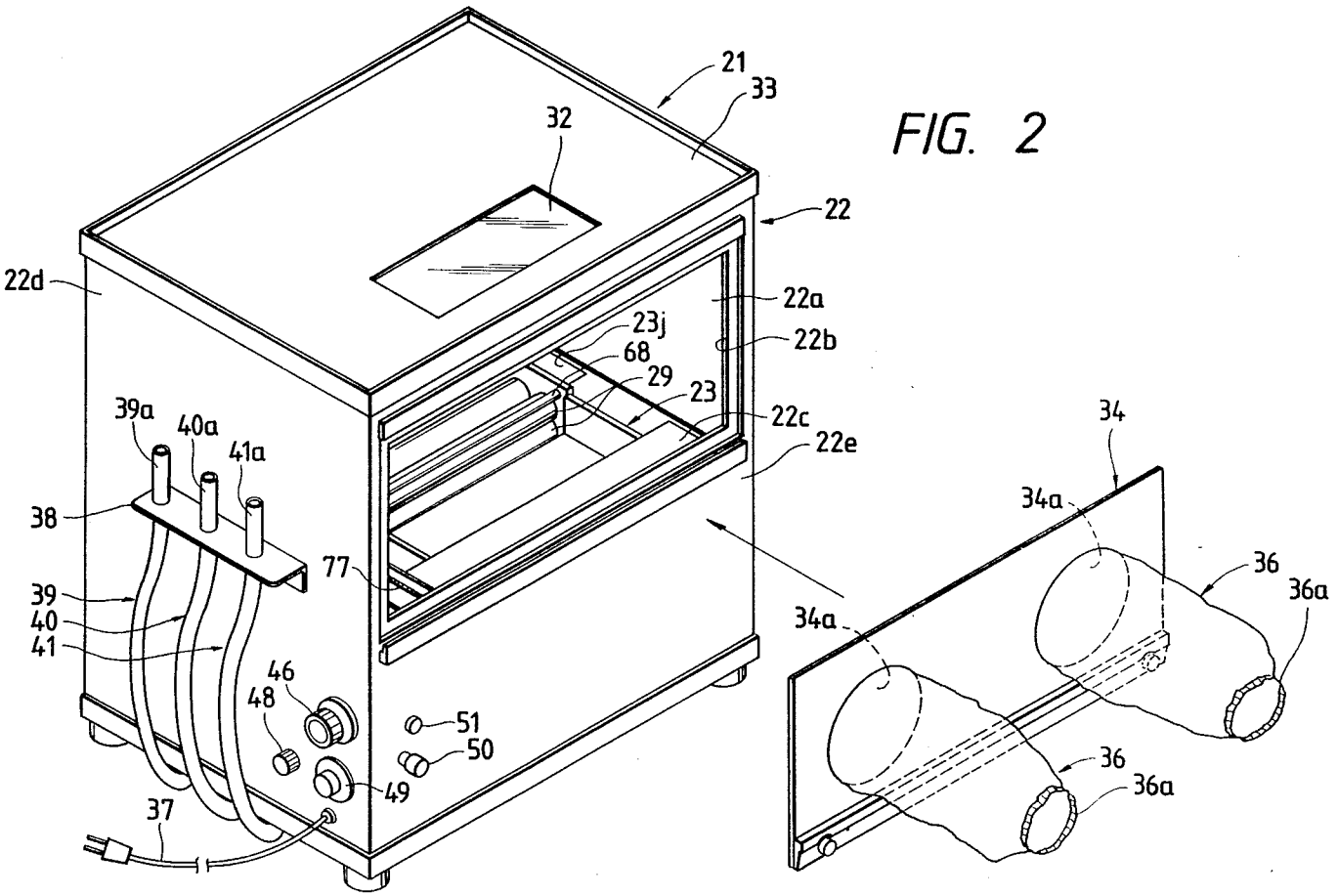
FIG. 2 is a perspective view of an automatic photographic processing apparatus having three such photographic processing units for the development, fixation and rinsing of a dental X-ray film.

FIG. 2 is a perspective view of an automatic processing apparatus 21 with its cover 34 removed. The apparatus 21 includes developing, fixing and rinsing units, the constitution and operation of each being the same in principle as those of the photographic processing unit shown in FIG. 1. The development casing 22 of the apparatus 21 is made of a material which blocks external light from reaching an already-exposed dental X-ray film. The casing 22 has an observation window 32 through which the interior 22*a* of the apparatus 21 can be observed. The window 32 is made of a special glass and located in the top plate 33 of the casing 22 at the center of the width thereof. The glass absorbs the rays of light to which the film is sensitive. Although the interior 22*a* of the development casing 22 looks dark and red through the observation window 32, the interior can be seen through the window clearly enough to take out the film from a case therefor and insert the film in between film conveyance rollers 29. An opening 22*b* is provided in the upper half of the front of the development casing 22. The cover 34 can be removably fitted on the opening 22*b*, and has handling holes 34*a* through which the arms of the person who operates the apparatus 21 are inserted so that he performs handling in the apparatus. Arm covers 36 made of a black cloth are attached to the cover 34 around the handling holes 34*a* thereof. Rubber rings 36*a* are provided on the arm covers 36 at the front ends thereof to prevent light from entering into the covers through openings between the arms of the person and the arm covers.

The front portion of the developing tank 23 of the automatic processing apparatus 21 has a space 22*c* in which the case for the film 31 is placed so that the film can be taken out from the case. The tank 23 is disposed inside the development casing 22. A bracket 38 is secured to the left-hand side 22*d* of the casing 22. A developing solution drain pipe 39, a fixing solution drain pipe 40 and a rinsing water drain pipe 41 are inserted into the bracket 38 at the ends 39*a*, 40*a* and 41*a* of the pipes and held by the bracket. A temperature control knob 46 for adjusting the temperature of a developing solution 43 and that of a fixing solution 44, a speed control knob 49 for adjusting the rotation speed of the film conveyance rollers 29 of the apparatus 21, a fuse 48 and a power supply cord 37 are attached to the side 22*d* of the casing 22. A power supply switch 50 and a power supply lamp 51 are attached to the front 22*e* of the casing 22.

Figure 3:
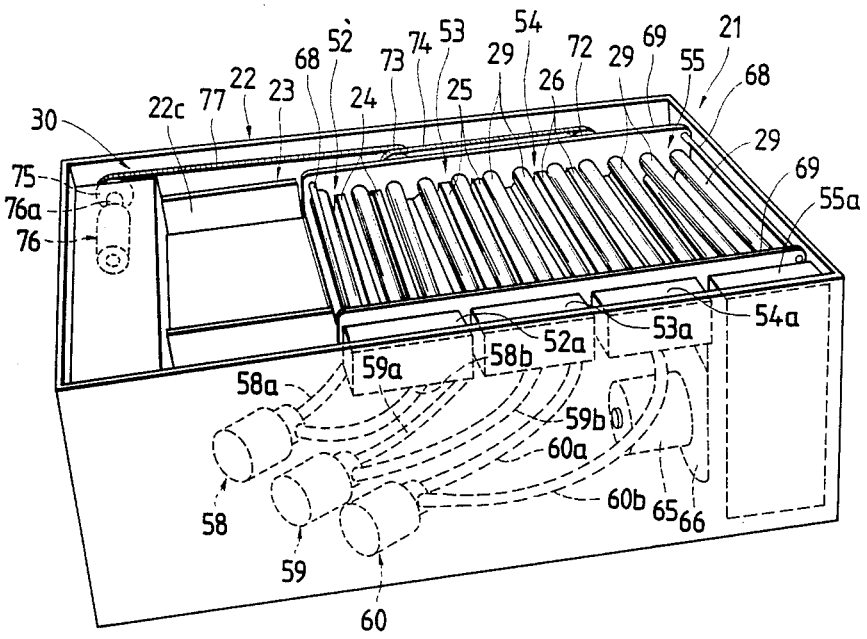
FIG. 3 is a perspective view of the drive mechanism and interior of the apparatus.
Figure 4:
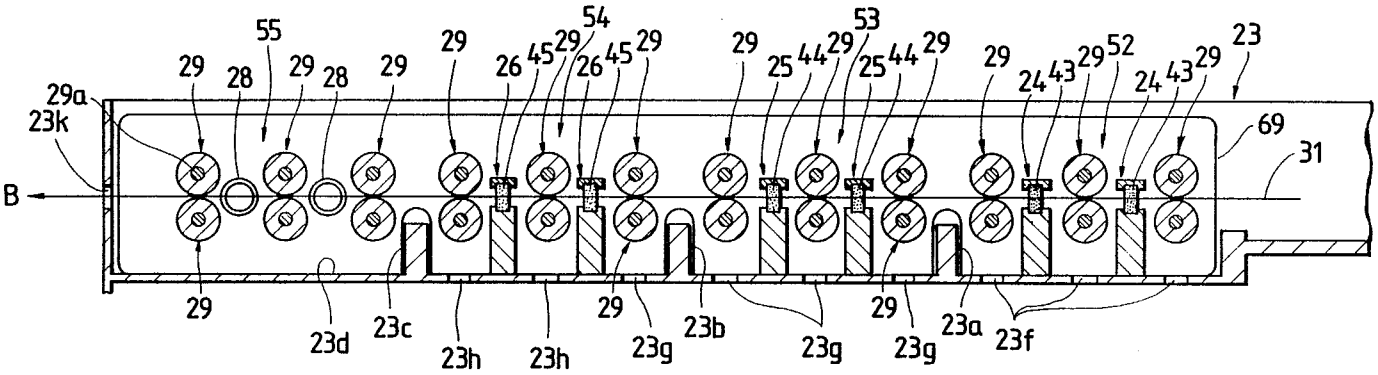
FIG. 4 is a partial sectional view of the apparatus.
Figure 5:
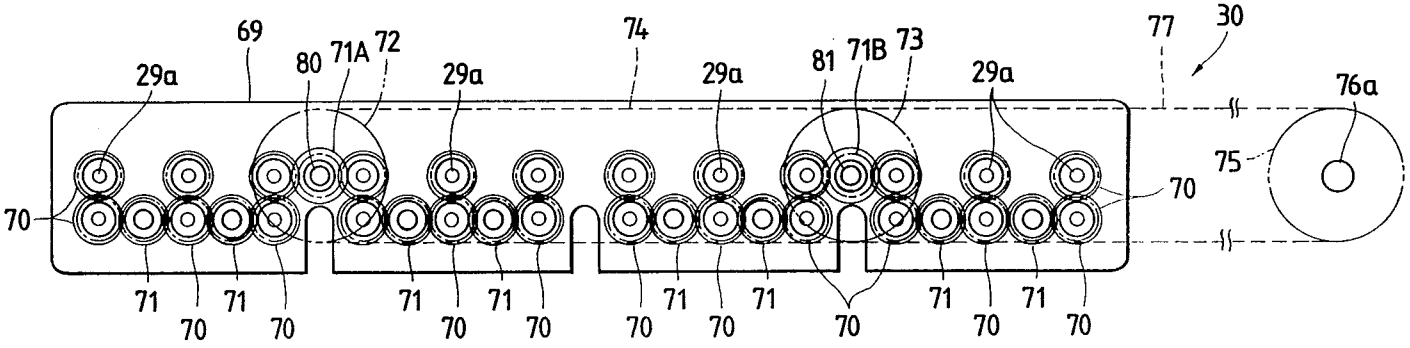
FIG. 5 is a side view of the drive mechanism.
Figure 6:
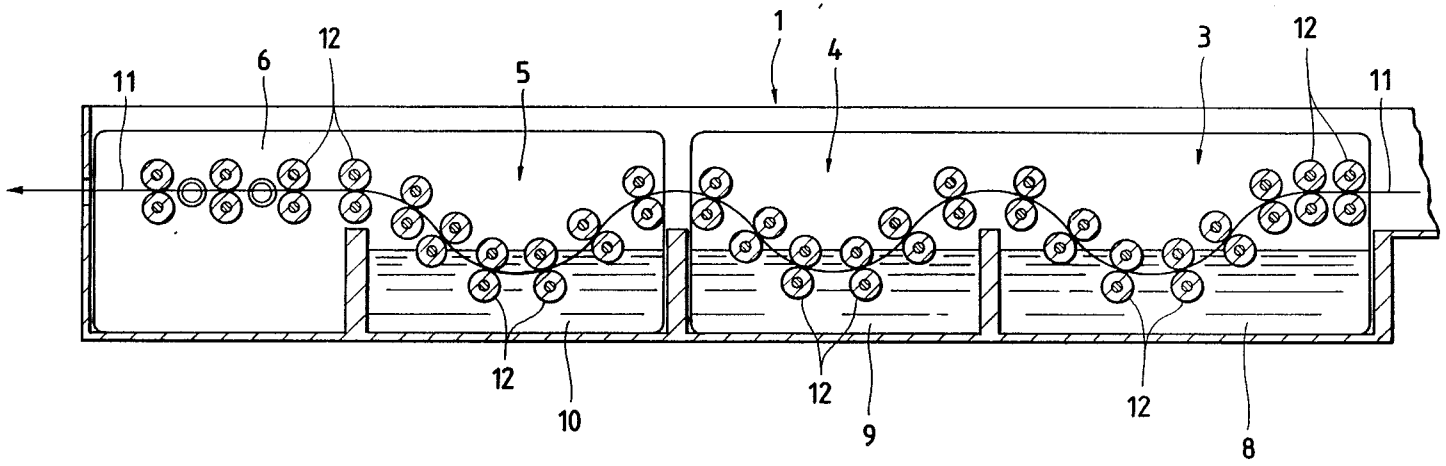
FIG. 6 is a sectional view of a conventional roller-type automatic photographic processing apparatus for processing in a darkroom.

FIG. 3 is a perspective view of the drive mechanism and interior of the automatic processing apparatus 21. FIG. 4 is a partial sectional view of the apparatus 21. FIG. 5 is a side view of the drive mechanism. The processing tank 23 of the apparatus 21 has a developing section 52, a fixing section 53, a rinsing section 54 and a drying chamber 55, which are located in that order in the direction of the movement of the film 31. The developing unit including developing chamber definition members 24 and some film conveyance rollers 29 is provided at the developing section 52. The fixing unit including fixing chamber definition members 25 and other film conveyance rollers 29 is provided at the fixing section 53. The rinsing unit including rinsing chamber definition members 26 and yet other film conveyance rollers 29 is provided at the rinsing section 54. The developing solution 43, the fixing solution 44 and rinsing water are handled in the developing, the fixing and the rinsing units in the same manner as in the photographic developing unit shown in FIG. 1. A pair of hot air feed ports 28 are provided in a side wall 69 for the drying chamber 55 so that hot air sent by a fan 66 driven by a motor 65 is blown into the drying chamber through a duct 55*a* and the feed ports perpendicularly to the direction of the movement of the film 31. Immediately after the hot air is blown into the drying chamber 55, the air freely diffuses so that the air flows mainly near the passage for the film 31 and dries the top and bottom thereof. The hot air thereafter goes out through a film outlet port 23*k*. The drying mechanism of the apparatus 21 is not confined thereto, but may be otherwise constituted so that the mechanism is made of members of the same form as the developing chamber definition members 24 and the hot air is caused to flow through the members. An appropriate blocking plate or film not shown in the drawings is set up between the rinsing section 54 and the drying chamber 55 to prevent the hot air from entering into the developing, the fixing and the rinsing sections 52, 53 and 54.

The developing section 52, the fixing section 53, the rinsing section 54 and the drying chamber 55 are separated from each other by partition walls 23*a*, 23*b* and 23*c*. The sections 52, 53 and 54 are provided with drain holes 23*f*, 23*g* and 23*h* at the bottoms of the sections so that the processing liquids flow out of the sections through the drain holes and are sent again to a developing solution stand 52*a*, a fixing solution stand 53*a* and a rinsing water stand 54*a* through recovery pipes 58*a*, 59*a* and 60*a* and feed pipes 58*b*, 59*b* and 60*b* by pumps 58, 59 and 60 and fed again to the processing sections during the processing of the film 31.

The film conveyance rollers 29 are disposed along a straight horizontal line, upstream and downstream to the developing chamber definition members 24 of the developing unit, the fixing chamber definition members 25 of the fixing unit, the rinsing chamber definition members 26 of the rinsing unit and the hot air feed ports 28 with regard to the direction of the movement of the film 31, and constitute vertical pairs so that the rollers convey the film and squeeze off the developing solution 43, the fixing solution 44 and the rinsing water 45 from the film. The rollers 29 are made of rubber or the like, which is resistant to chemicals, water and heat. The cross section of each of the rollers 29 is circular. The core of each roller 29 is a rotary shaft 29*a* secured to the rubber and rotatably supported at both ends of the shaft by a pair of plastic bearing plates 69 secured at a prescribed distance from each other. The rotary shaft 29 is loosely fitted in the bearing plates 69 so that the upper film conveyance roller 29 is in pressure contact with the corresponding lower film conveyance roller 29 because of the weight of the upper roller. The height of the point of the pressure contact is the same as that of the slots 24*b* of the developing chamber definition members 24 and the slots of the fixing and the rinsing chamber definition members 25 and 26, namely, the height is the same as that of the conveyance passage for the film 31. The total number of the film conveyance rollers 29 of the apparatus 21 is twenty-four.

The drive mechanism 30 of the apparatus 21 is for rotating the film conveyance rollers 29, and comprises twenty-four drive gears 70 provided for the rotary shafts 29*a* of the rollers, ten idle gears 71 which connect the drive gears to each other to transmit motive power and make the directions of the rotation of the gears the same as each other, a pair of sprockets 72 and 73 secured to rotary shafts 80 and 81 coaxial with particular ones 71A and 71B of the idle gears, a chain 74 engaged with the sprockets, a motor 76, a sprocket 75 secured to the rotary shaft 76*a* of the motor, and a chain 77 engaged with the sprockets 73 and 75. Motive power is transmitted from the motor 76 to the sprocket 73 through the sprocket 75 and the chain 77 and then transmitted to the sprocket 72 through the chain 74. Motive power is transmitted from the sprocket 73 to the idle gear 71B so that the twelve drive gears 70 shown in the right-hand half of FIG. 4 are driven through the idle gear. Motive power is transmitted from the sprocket 72 to the idle gear 71A so that the other twelve drive gears 70 shown in the left-hand half of FIG. 4 are driven through the idle gear. Although the drive gears 70 and the idle gears 71 are all spur gears, worm gears may be provided instead.

The film 31 is conveyed by the film conveyance rollers 29 so that the film moves in a straight horizontal direction through the developing chamber definition members 24, the fixing chamber definition members 25 and the rinsing chamber definition members 26 in that order and then moves through hot air pipes 28 for drying the film.

The processing of the film 31 by the automatic processing apparatus 21 will now be described with reference to FIGS. 2, 3, 4 and 5. The developing solution 43 is poured from the developing solution drain pipe 39 into the developing section 52 so that the drain holes 23*f*, the developing solution recovery pipe 58*a* and the developing solution pump 58 are filled with the developing solution and the pump is operated. The fixing solution 44 is poured from the fixing solution drain pipe 40 into the fixing section 53 so that the drain holes 23*g*, the fixing solution recovery pipe 59*a* and the fixing solution pump 59 are filled with the fixing solution and the pump is operated. The rinsing water 45 is poured from the rinsing water drain pipe 41 into the rinsing section 54 so that the drain holes 23*h*, the rinsing water recovery pipe 60*a* and the rinsing water pump 60 are filled with the rinsing water and the pump is operated. Thus, the pumps 58, 59 and 60, which are special liquid pumps made of ceramic, are lubricated with the processing liquids 43, 44 and 45 so that electricity may be applied to the pumps to drive them. When the power supply switch 50 is turned on, the power supply lamp 51 is lit and the pumps 58, 59 and 60, the motors 65 and 76 and the hot air fan 66 are driven. When the developing solution 43 is sent from the developing solution feed pipe 58*b* to the developing solution stand 52*a* and ejected from the feed ports 52*b* thereof, the solution very smoothly flows in the form of bars of quadrangular cross section in the developing chambers of the developing chamber definition members 24 as shown in FIG. 1. After the developing solution 43 reaches the tips of the members 24, the solution flows out through the slots 24*b* thereof and falls onto the bottom plate 23*d* of the processing tank 23. The developing solution 43 is thereafter sucked into the developing solution pump 58 through the drain holes 23*f* and the developing solution recovery pipe 58*a* and fed again to the developing chambers through the developing solution feed pipe 58*b* as shown by arrows A in FIG. 1. The developing solution 43 and the fixing solution 44 are kept at an appropriate temperature such as 28° C. by setting the temperature control knob 48. The hot air is sent, under pressure, from the hot air fan 66 and blown out from the hot air feed ports 28 into the drying chamber 55 to make the temperature therein high enough to dry the film 31. In the drive mechanism 30, the motor 76 begins to rotate to revolve the chain 77, the sprocket 73, the chain 74 and the sprocket 72. As a result, the twelve drive gears 70 shown in the right-hand half of FIG. 5 are rotated through the sprocket 73 and the idle gear 71B so that the twelve film conveyance rollers 29 are rotated. At the same time, the other twelve drive gears 70 shown in the left-hand half of FIG. 5 are rotated through the sprocket 72 and the idle gear 71A so that the other twelve film conveyance rollers 29 are rotated. With regard to FIG. 4, the upper film conveyance rollers 29 are rotated clockwise and the lower film conveyance rollers 29 are rotated counterclockwise. The rotation speed of the film conveyance rollers 29, which corresponds to the conveyance speed of the film 31, can be adjusted by setting the speed control knob 49 to regulate the motor 76.

After the preparations for the processing of the film 31 by the automatic processing apparatus 21 are made in the above-described procedure, the operator removes the cover 34 from the casing 22 of the apparatus, puts the case containing the exposed dental film 31 in the space 22*c* of the casing, attaches the cover back to the casing, inserts both of his arms into the arm covers 36, takes out the film from the case, and inserts the film in between the foremost pair of film conveyance rollers 29 at the developing section 52. Since the rollers 29 have already begun to rotate, the film 31 is pulled in by the rollers so that the film passes through the developing solution 43 circulating through the slots 24*b* of the front developing chamber definition member 24 at the developing section 52, as shown in FIG. 4. The film 31 is thus subjected to first development. After that, the developing solution clinging to the film 31 is squeezed off therefrom by the following pair of film conveyance rollers 29. The film 31 then passes through the developing solution 43 in the rear developing chamber definition member 24 so that the film is subjected to second and finishing development. After that, the developing solution 43 clinging to the film 31 is squeezed off therefrom by the next following pair of film conveyance rollers 29. The squeezed-off developing solution 43 is recovered through the drain holes 23*f*, the developing solution recovery pipe 58*a* and the developing solution pump 58 together with the developing solution having flowed down from the slots 24*b* of the developing chamber definition members 24.

After that, the fixation and rinsing of the film 31 are performed by the automatic processing apparatus 21 in the same manner as the development of the film.

The film 31 is thereafter conveyed into the drying chamber 55 so that the film is dried by the hot air 47 ejected from the hot air feed ports 28. The dried film 31 is conveyed out from the processing tank 23 and the casing 22 through the slot 23*k* of the tank as shown by an arrow B in FIG. 4. The processing of the film 31 is thus completed. The time which it takes to perform the development, fixation, rinsing and drying of the dental X-ray film 31 is about two minutes and thirty seconds.

Since the film 31 is conveyed along a straight line path by the twenty-four film conveyance rollers 29 and is not bent as in the conventional apparatus, the film is very unlikely to be damaged due to the conveyance. Since the rollers 29 are not dipped in the developing and the fixing solutions 43 and 44, the rollers are less likely to be contaminated and therefore need to be cleaned less frequently than in the conventional apparatus art.

Although the processing of the dental X-ray film 31 is described above, the use of the automatic processing apparatus 21 is not confined thereto but other black and white films, color films, color printing paper or the like can be processed by the apparatus if appropriate processing units and appropriate processing liquids are selected depending on the kind of the processed material.

What is claimed is:

1. A photographic processing unit in which a photographic photosensitive material exposed to imaging light is processed while being moved in a horizontal direction, characterized in that said unit includes two pairs of conveyance rollers, and a processing chamber definition member having a butt end and a top end; said rollers extending in parallel with each other and said two pairs of rollers being disposed at a prescribed distance from each other in said direction so as to convey said material in said direction; said member is disposed between said pairs of conveyance rollers and extends in parallel with said rollers perpendicularly across said direction, over the total width of said material; a processing chamber is defined in said member; said member has an inlet slot and an outlet slot along said direction so that said material is moved into said member through said inlet slot and moved out of said member through said outlet slot; a processing liquid feed port for feeding a processing liquid into said chamber provided in said member at the butt end thereof, wherein said processing chamber definition member has an upper groove and a mating lower groove which together define said processing chamber; said inlet slot and said outlet slot communicating with said upper and lower grooves such that said material entering said inlet slot and exiting said outlet slot will pass through and be immersed in the processing liquid flowing through said chamber.

2. A photographic processing unit as claimed in claim 1, further comprising a tank positioned below said processing chamber definition member and said conveyance rollers to catch the processing liquid exiting said chamber via said slots and squeezed off said material by said rollers, and pumping conveyance means for conveying said liquid in said tank to said processing liquid feed port.

3. A photographic processing unit as claimed in claim 2, wherein said processing chamber definition member is closed at the tip end thereof.

4. A photographic processing unit as claimed in any one of claims 1, 2 or 3, further comprising a second processing chamber definition member disposed downstream of said pair of conveyance rollers which are downstream, in turn, from said first processing chamber definition member, and a third pair of conveyance rollers positioned downstream of said second processing chamber definition member; said second member being substantially identical to said first member, and all said pairs of rollers and said processing chamber definition members being positioned to guide said material therethrough in a straight horizontal path without vertical zigzag motion.

5. A photographic photosensitive material processing apparatus of the type having at least developing, fixing and rinsing processing units for applying developing, fixing and rinsing solutions to a said material to be processed and for conveying said material in a conveyance direction to said solutions and between said units, the improvement wherein each said processing unit comprises:

two pairs of conveyance rollers, and a processing chamber definition member having a butt end and a tip end; said rollers extending in parallel with each other and two said pairs of rollers being disposed at a prescribed distance from each other in said direction so as to convey said material in said direction; said member is disposed between said pairs of conveyance rollers and extends in parallel with said rollers perpendicularly across said direction, over the total width of said material; a processing chamber is defined in said member; said member has an inlet slot and an outlet slot along said direction so that said material is moved into said member through said inlet slot and moved out of said member through said outlet slot; a processing liquid feed port for feeding a processing liquid into said chamber provided in said member at the butt end thereof, wherein said processing chamber definition member has an upper groove and a mating lower groove which together define said processing chamber; said inlet slot and said outlet slot communicating with said upper and lower grooves such that said material entering said inlet slot an exiting said outlet slot will pass through and be immersed in the processing liquid flowing through said chamber.

6. A photographic photosensitive material processing apparatus as claimed in claim 5, further comprising a tank positioned below said processing chamber definition member and said conveyance rollers to catch the processing liquid exiting said chamber via said slots and squeezed off said material by said rollers, and pumping conveyance means for conveying said liquid in said tank to said processing liquid feed port.

7. A photographic photosensitive material processing apparatus as claimed in claim 6, wherein said processing chamber definition member is closed at the tip end thereof.

8. A photographic photosensitive material processing apparatus as claimed in any one of claims 5, 6 or 7, further comprising a second processing chamber definition member disposed downstream of said pair of conveyance rollers which are downstream, in turn, from said first processing chamber definition member, and a third pair of conveyance rollers positioned downstream of said second processing chamber definition member; said second member being substantially identical to said first member, and all said pairs of rollers and said processing chamber definition members being positioned to guide said material therethrough in a straight horizontal path without vertical zigzag motion.

9. A photographic photosensitive material processing apparatus as claimed in claim 8, wherein each of said processing units is placed relative to all other said processing units such that said material travels in a straight horizontal path through and between all said processing units.

* * * * *